US008216080B2

(12) United States Patent
Park

(10) Patent No.: US 8,216,080 B2
(45) Date of Patent: Jul. 10, 2012

(54) APPARATUS FOR CORRECTING GOLF POSE

(75) Inventor: Hyun-Yong Park, Seoul (KR)

(73) Assignee: Hyun-Yong Park, Seoul (KR)

( * ) Notice: Subject to any disclaimer, the term of this patent is extended or adjusted under 35 U.S.C. 154(b) by 155 days.

(21) Appl. No.: 12/704,747

(22) Filed: Feb. 12, 2010

(65) Prior Publication Data

US 2011/0045918 A1 Feb. 24, 2011

(30) Foreign Application Priority Data

Aug. 20, 2009 (KR) ..... 10-2009-0077147

(51) Int. Cl.
*A63B 69/36* (2006.01)

(52) U.S. Cl. ..... 473/218; 473/257; 473/258

(58) Field of Classification Search ..... 473/218, 473/258

See application file for complete search history.

(56) References Cited

U.S. PATENT DOCUMENTS 5,375,833 A * 12/1994 Marier, Jr. ..... 473/261

FOREIGN PATENT DOCUMENTS

| | | | |
|---|---|---|---|
| JP | 58185181 | A | 10/1983 |
| JP | 19913015550 | U | 2/1991 |
| KR | 200425800 | Y1 | 9/2006 |

* cited by examiner

*Primary Examiner* — Michael Dennis
(74) *Attorney, Agent, or Firm* — Dority & Manning, P.A.

(57) ABSTRACT

Disclosed is an apparatus for correcting a golf pose, the apparatus including: a supporting member formed to be adjustable in length and angle; a leg member installed at one end part of the supporting member and supported on a ground; and an interfering member formed retractably in a lengthwise direction and detachably installed to the other end part of the supporting member through a detachable member.

6 Claims, 12 Drawing Sheets

APPARATUS FOR CORRECTING GOLF POSE

CROSS-REFERENCE TO RELATED APPLICATION

This application claims priority to and the benefit of Korean Patent Application No. 10-2009-0077147 filed in the Korean intellectual Property Office on Aug. 20, 2009, the entire contents of which are incorporated herein by reference.

BACKGROUND OF THE INVENTION (a) Field of the Invention

The present invention relates to an apparatus for correcting a golf pose, and more particularly, to an apparatus for correcting a golf pose, in which an interfering member is separated from a main body when contacting a club head or a user's body, thereby easily correcting that a pose is lost or the club head is deviates from a swing path.

(b) Description of the Related Art

In general, golf is sport of which victory or defeat is determined depending on how accurate an impact point between a club and a ball is and how strong an impact power is, so that it can be a precondition for helping a beginner become a good golf player to correct an unstable swing pose and an inaccurate impact point.

A swing of the golf is divided into a back swing, a down swing, impact, follow-through, and a finish. Among these swing actions, the back swing, the down swing and the follow-through of a club shaft before and after the impact need to be practiced so that all the swing poses thereof can pass through a line as straight as possible. Of course, a pose at the swing has to be also practiced to accomplish a steady pattern.

To this end, a beginner has conventionally been coached on the swing poses by an expert and then practiced the swing poses by him/herself so as to learn such a series of successive actions before and after the impact.

However, in the case that a beginner does a swing practice alone, it may be difficult for him/her to acquire a correct swing pose. Further, if s/he is addicted to an incorrect swing pose, it may take more time to correct the incorrect swing pose.

Accordingly, there has been required an apparatus for correcting the swing pose when a user is alone. In particular, there is need of a means for balancing a swing path of the club shaft before and after the impact.

SUMMARY OF THE INVENTION

Accordingly, the present invention is conceived to solve the forgoing problems, and an aspect of the present invention is to provide an apparatus for correcting a golf pose, in which an interfering member is separated from a supporting member when contacting a part of a user's body or a club head as a swing pose is lost or a club deviates from a swing path, thereby easily correcting the swing pose or the swing path of the club.

Another aspect of the present invention is to provide an apparatus for correcting a golf pose, which can be used in correction for various applicable poses by adjusting the length and angle of the supporting member, and expand its usage for not only a beginner but also a superior since the length of the interfering member is flexible corresponding to a user's ability or use.

Still another aspect of the present invention is to provide an apparatus for correcting a golf pose, which can prevent the supporting member supported by a leg member from easily falling or changing in its position because the interfering member attached to the supporting member by a magnetic force can be readily separated when contacting a part of a user's body or the club head.

Yet another aspect of the present invention is to provide an apparatus for correcting a golf pose, in which a first member and a second member used as contact members that attach the interfering member to the supporting member are connected by an elastic wire, so that the interfering member can be easily attached again since it is prevented from moving far away even though the interfering member is separated.

An exemplary embodiment of the present invention provides an apparatus for correcting a golf pose, the apparatus including: a supporting member formed to be adjustable in length and angle; a leg member installed at one end part of the supporting member and supported on a ground; and an interfering member formed retractably in a lengthwise direction and detachably installed to the other end part of the supporting member through a detachable member.

The interfering member may include at least one length adjusting unit to be adjusted in length.

The length adjusting unit may include a wrinkled tube maintained in an adjusted length.

The interfering member may be made of a soft synthetic resin, and may be transparent in a middle part but opaque at opposite end parts.

The detachable member may include a first member coupled to the other end part of the supporting member, and a second member fastened to the middle part of the interefering member and attached to/detached from the first member with a magnetic force.

The detacable member may further include an elastic wire connecting the first member and the second member.

The apparatus may further include a weight fastened to a lower end part of the supporting member and improving stability when installed on the ground.

The leg member may include a bracket surrounding an outer circumference of the lower end part of the supporting member, a plurality of legs of which an upper end part is rotatably coupled to the bracket, and a foot formed in a lower end part of the leg and enlarging a contact area with the ground.

The supporting member may include a first adjusting unit having a retractable structure like an antenna and fastened to the leg member, a second adjusting unit having a retractable structure like an antenna and fastened to the interfering member, and a connecting unit connecting the first adjusting unit and the second adjusting unit such that the second adjusting unit can rotate in up, down, left and right directions.

The connecting unit may include a camera plate onto which a camera can be selectively installed.

The connecting unit may include an insertion groove at one side thereof, in which a mobile phone of a user can be inserted.

DETAILED DESCRIPTION OF THE EMBODIMENTS

Figure 1:
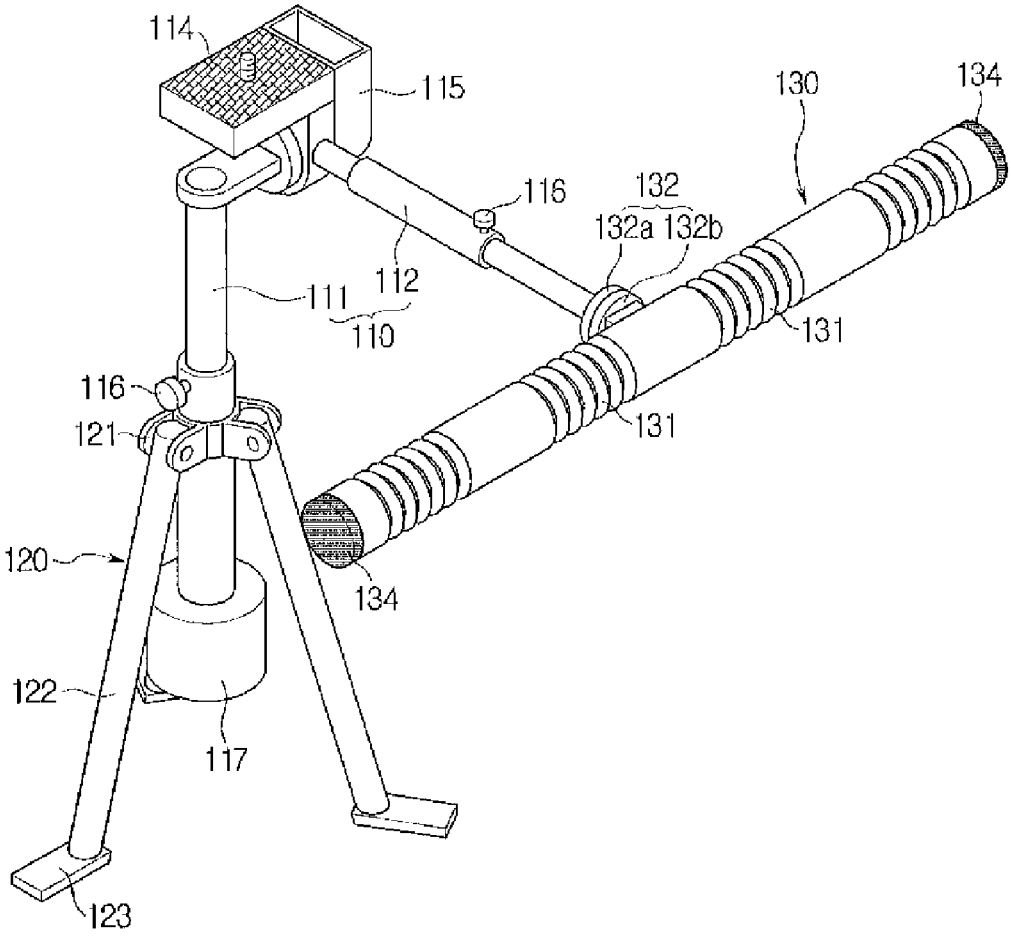
FIG. 1 is a perspective view of an apparatus for correcting a golf pose according to an exemplary embodiment of the present invention.

Prior to description, elements will be representatively explained in an embodiment and only different configurations will be described in another embodiment, in which like reference numerals refer to like elements throughout the embodiments.

Hereinafter, an apparatus for correcting a golf pose according to a first exemplary embodiment of the present invention will be described with reference to the accompanying drawings.

Figure 2:
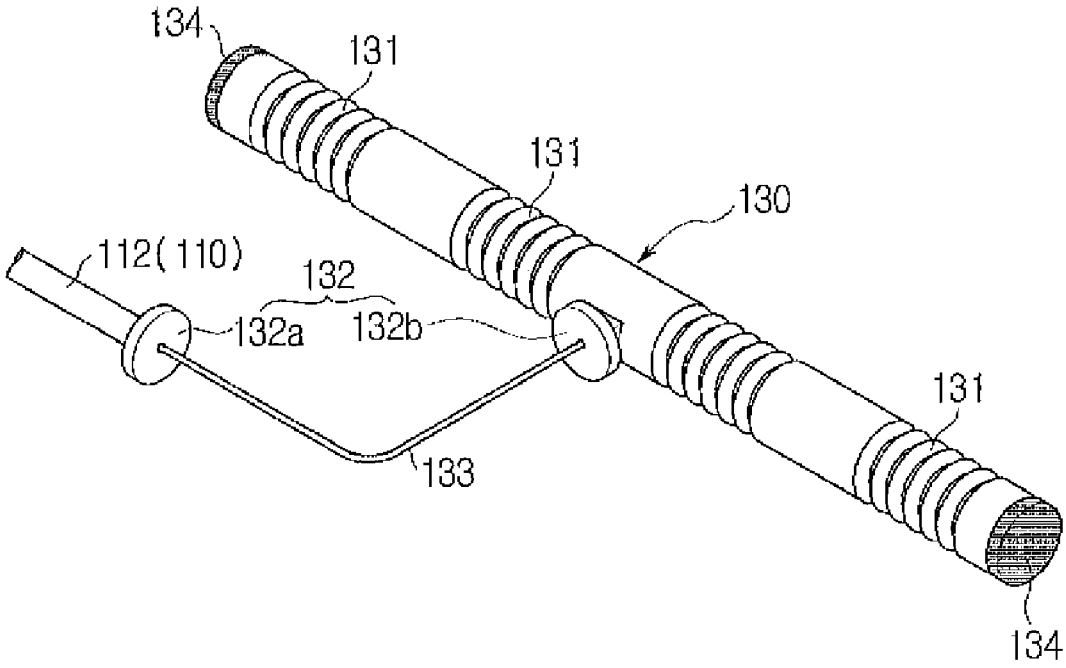
FIG. 2 is a perspective view showing that an interfering member is separated in the apparatus for correcting the golf pose according to an exemplary embodiment of the present invention.

Among the accompanying drawings, FIG. 1 is a perspective view of an apparatus for correcting a golf pose according to an exemplary embodiment of the present invention, and FIG. 2 is a perspective view showing that an interfering member is separated in the apparatus for correcting the golf pose according to an exemplary embodiment of the present invention.

As shown therein, the apparatus for correcting the golf pose according to this embodiment broadly includes a supporting member 110, a leg member 120 and an interfering member 130.

The supporting member 110 includes a first adjusting unit 111 having a retractable structure like an antenna and fastened to the leg member 120, a second adjusting unit 112 having a retractable structure like an antenna and fastened to the interfering member 130, a connecting unit 113 connecting the first adjusting unit 111 and the second adjusting unit 112 and rotatable in up, down, left and right directions, a camera plate 114 provided in an upper side of the connecting unit 113 and selectively holding a camera, and an insertion groove 115 formed at one side of the connecting unit 113 and safekeeping a user's belongings such as a mobile phone or the like. Meanwhile, the first adjusting unit 111, the second adjusting unit 112 and the connecting unit 113 may include a stopper to settle the adjusted length and angle.

The leg member 120 is provided at a first end part of the supporting member 110 in a folding way and supported on the ground, which includes a bracket 121 surrounding an outer circumference of the supporting member 110, a plurality of legs 122 of which an upper end part is rotatably coupled to the bracket 121, and a foot 123 formed in a lower end part of the leg 122 and enlarging a contact area with the ground. Here, the leg 122 has the retractable structure like an antenna and thus the length thereof can be adjusted.

Meanwhile, a lower end part of the supporting member 110 is provided with a weight 117 to enhance stability when installed on the ground.

The interfering member 130 includes a plurality of wrinkled tubes as a length adjusting unit 131 at opposite sides of a cylindrical body thereof so that the length of the interfering member 130 can be adjusted by folding or unfolding the wrinkled tubes according to a user's ability or use, and a detachable member 132 in the middle of the cylindrical body so that it can be attached to a second end part of the supporting member 110. Here, the detachable member 132 includes a first member 132*a* assembled to the second end part of the supporting member 110 and, and a second member 132*b* fastened to the middle of the interfering member 130 and attached to/detached from from the first member 132*a* by a magnetic force. The first member 132*a* and the second member 132*b* are connected by an elastic wire 133. Meanwhile, the interfering member 130 is made of not only a soft synthetic resin to be prevented from damage, but also a transparent material to allowing a user to see a ball therethrough. Further, opaque parts 134 are provided at opposite end parts of the interfering member 130.

Also, there are provided the interfering members 130, the length of which can be adjusted within a range from 20 to 40 cm and a range from 40 to 70 cm, respectively, so that they can be interchanged according to use by selectively coupling the first member 132*a* thereof to the second adjusting unit 112.

Below, an operation of the foregoing apparatus for correcting the golf pose according to the first exemplary embodiment will be described.

Figure 3:
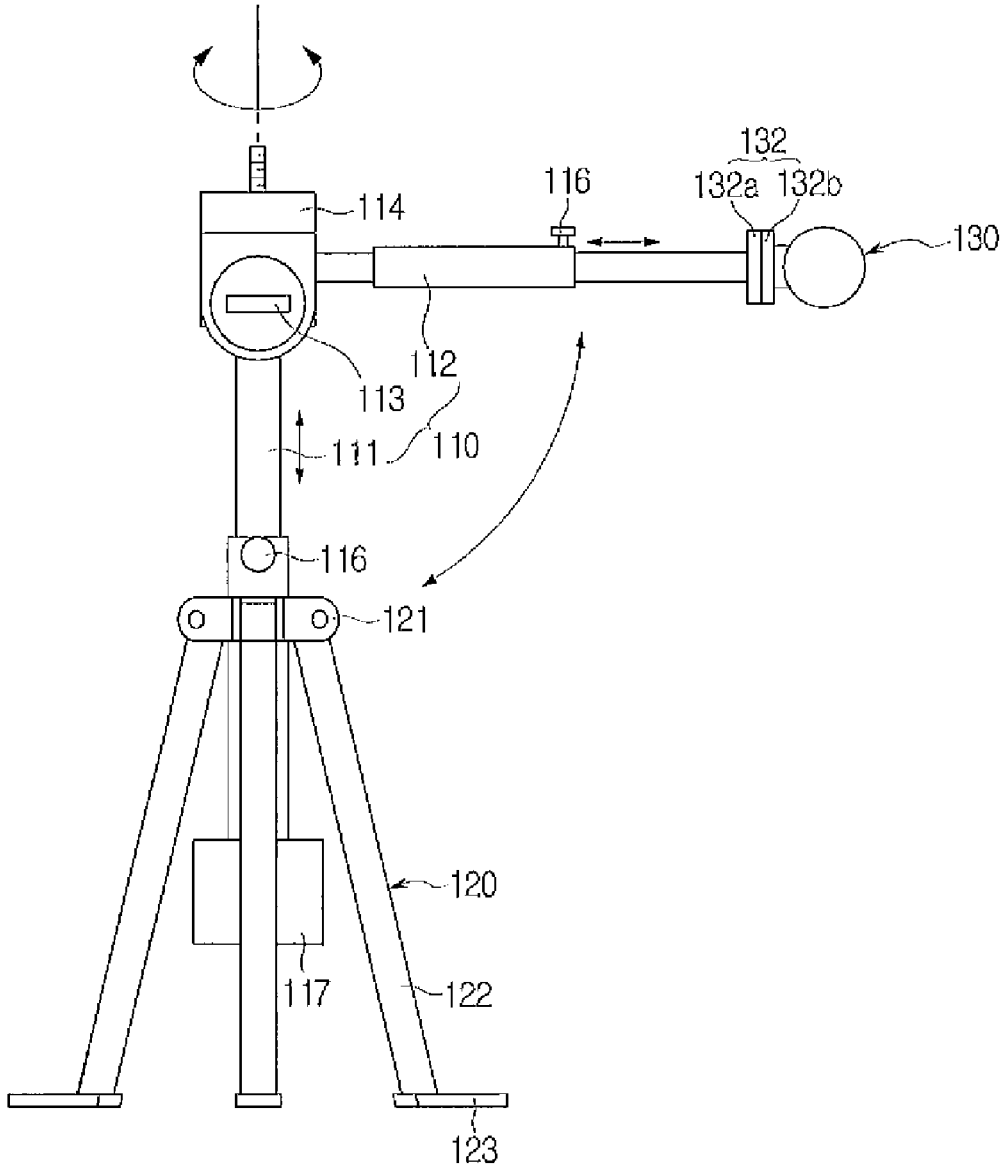
FIG. 3 is a lateral view of the apparatus for correcting the golf pose according to an exemplary embodiment of the present invention.
Figure 4:
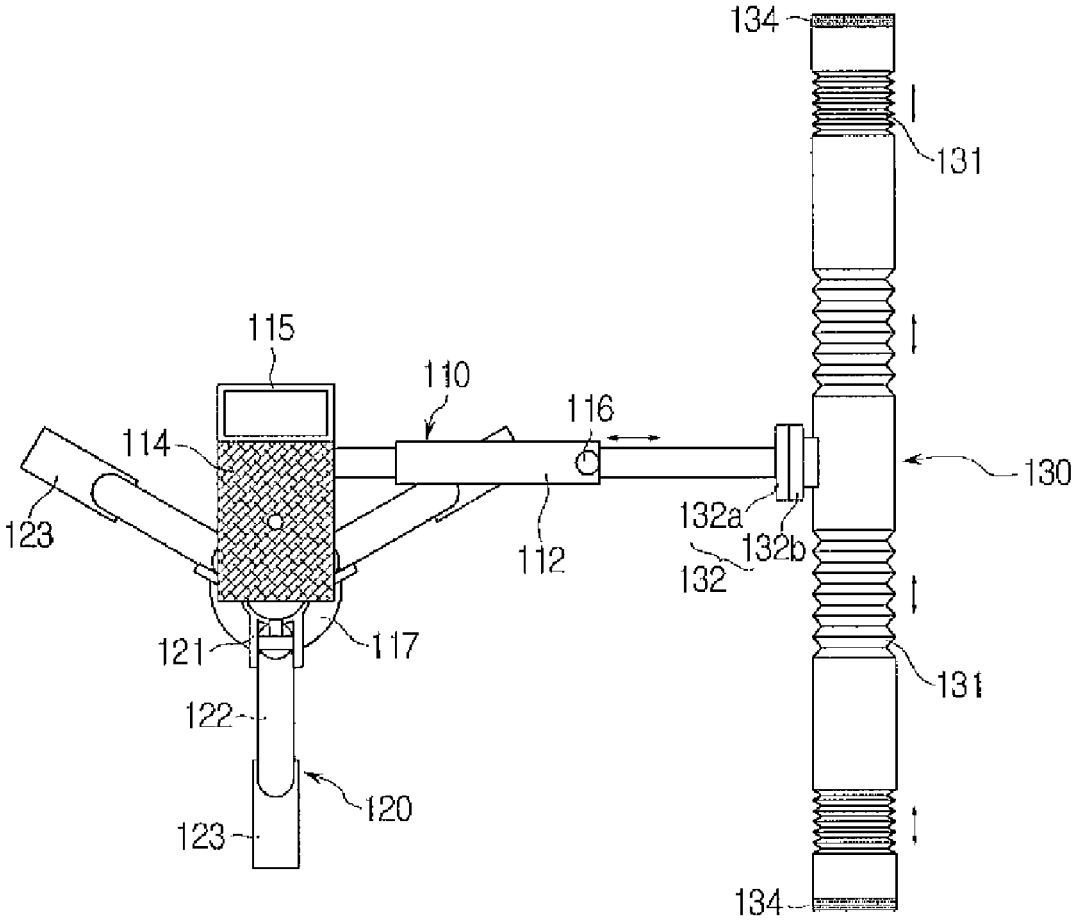
FIG. 4 is a plan view of the apparatus for correcting the golf pose according to an exemplary embodiment of the present invention.

Among the accompanying drawings, FIG. 3 is a lateral view of the apparatus for correcting the golf pose according to an exemplary embodiment of the present invention; and FIG. 4 is a plan view of the apparatus for correcting the golf pose according to an exemplary embodiment of the present invention.

As shown in FIG. 3, the supporting member 110, the length and angle of which are adjustable, includes a first side supported on the ground by the leg member 120, and a second side installed with the interfering member 130, so that the interfering member 130 can be disposed at a desired position and a desired angle by adjusting the length and angle of the supporting member 110.

The leg member 120 supports the supporting member 110 on the ground in the state that three or more legs 122 rotatably coupled to the bracket 121 surrounding the outer circumference of the first adjusting unit 111 of the supporting member 110 are outstretched. At this time, the foot 123 formed in the lower end part of the leg 122 comes close contact with the ground, and increases a contact area with the ground, thereby enhancing a supporting effect.

Further, the weight 117 is coupled to the lower end part of the supporting member 110 protruding under the bracket 121 of the leg member 120 improves stability so that the apparatus for correcting the golf pose can be prevented from easily falling by an external force when installed on the ground.

As mentioned above, the angle of the supporting member 110 supported on the ground by the leg member 120 is adjustable in up, down, left and right directions through the connecting unit 113 provided between the first adjusting unit 111 and the second adjusting unit 112, so that the interfering member 130 installed at an end part of the second adjusting unit 112 can be adjusted at a desired angle. Also, the height of the supporting member 110 is adjustable through the first adjusting unit 111, and a protruding length of the interfering member 130 is adjustable through the first adjusting unit 112.

Thus, a user can adjust the position and angle of the interfering member 130 through the supporting member 110 according to the pose and its degree of difficulty s/he wants to practice.

In the meantime, the lengths of the first adjusting unit 111 and the second adjusting unit 112 and the angle of the connecting unit 113 may be fixed by stoppers 116, respectively.

Further, a camera can be selectively installed on the camera plate 114 provided in the upper side of the connecting unit 113 so as to photograph a user's pose, and a mobile phone or the like can be safekept in the insertion groove 115 formed at one side of the connecting unit 113.

As shown in FIG. 4, the interfering member 130 is attached to the end part of the second adjusting unit 112 through the detachable member 132, so that the interfering member 130 can be deteched from the second adjusting unit 112 as a holding force of the detachable member 132 is released when receiving an external impact.

In other words, in the state that the first member 132*a* of the detachable member 132 is fastened to the second adjusting unit 112 and the second member 132*b* is fastened to the middle of the interfering member 130, the second member 132*b* is attached to the first member 132*a* with a magnetic force, thereby attaching the interfering member 130 to the supporting member 110.

Thus, when the interfering member 130 receives impact from the exterior, the second member 132*b* is released from the first member 132*a*, so that the interfering member 130 can be detached from the supporting member 110. At this time, the elastic wire 133 connecting the first member 132*a* and the second member 132*b* prevents the second member 132*b* from moving far away, thereby facilitating reattachment.

Also, the interfering member 130 includes the length adjusting unit 131 in the form of at least two wrinkled tubes on the cylindrical body thereof. Through this length adjusting unit 131, the length of the interfering member 130 can be increased or decreased properly according to a user's level or use.

Further, since the interfering member 130 is made of a transparent soft synthetic resin, it is not easily damaged by the external impact and does not interfere with a user's eyes on a ball. The opaque parts 134 are conspicuously provided at the opposite end parts of the interfering member 130, it is easy to intentionally avoid the interference with the opposite end parts of the interfering member 130.

Among the accompanying drawings, FIGS. 5 to 12 are schematic views showing use of the apparatus for correcting the golf pose according to an exemplary embodiment of the present invention.

Figure 5:
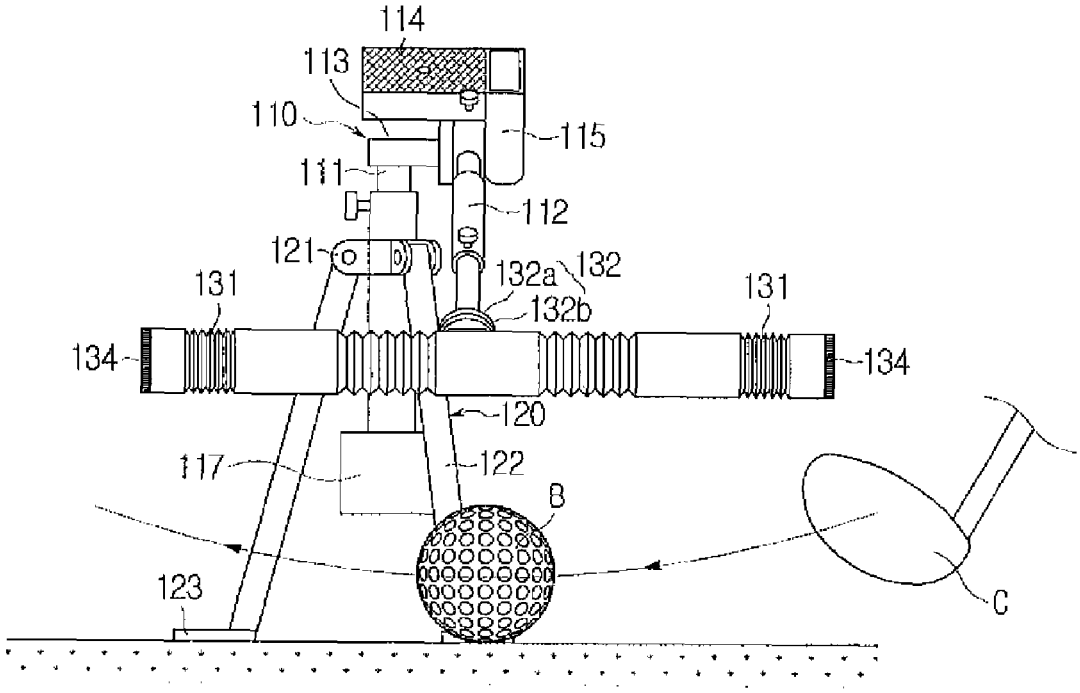
FIGS. 5 to 12 are schematic views showing use of the apparatus for correcting the golf pose according to an exemplary embodiment of the present invention.
Figure 6:
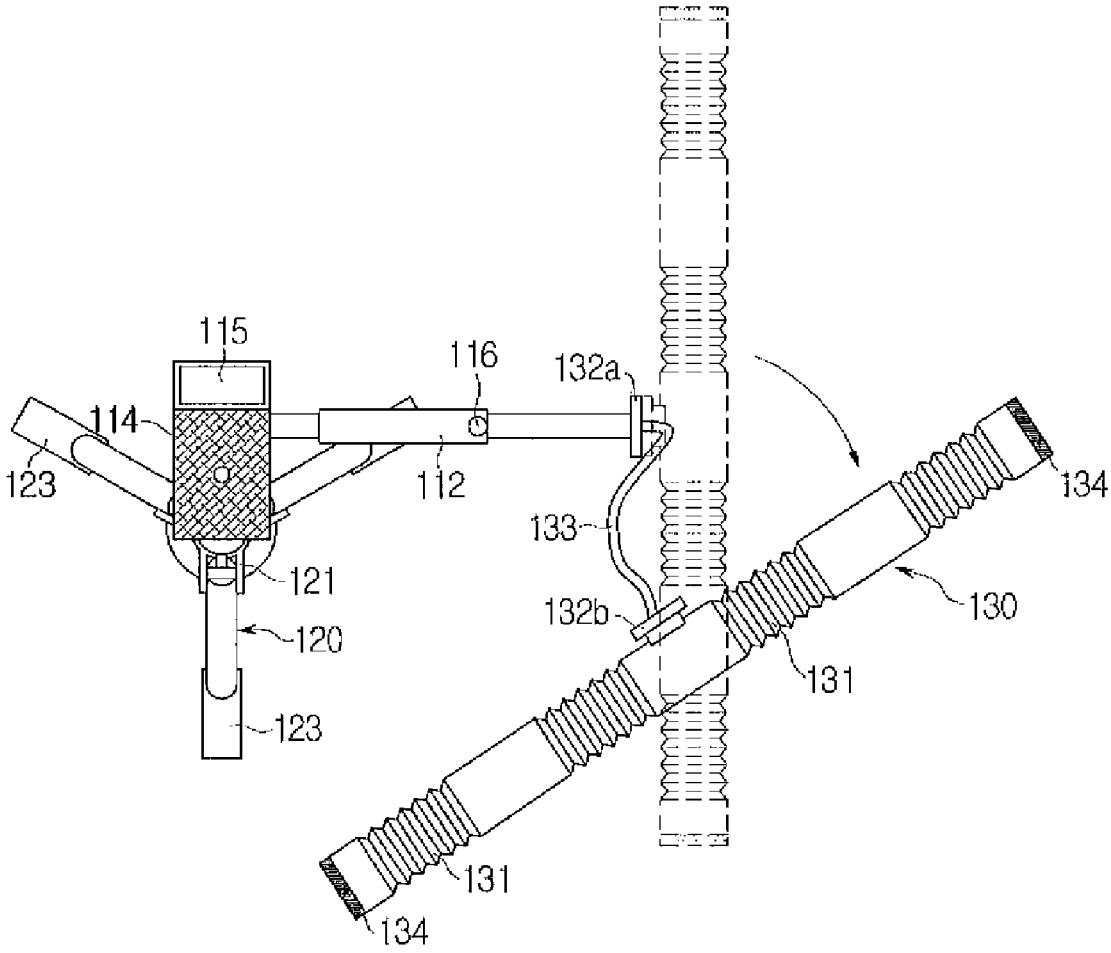

First, FIGS. 5 and 6 are for a swing pose where a head of a club C passes between the ground and the interfering member 130 tracing an arc as large as possible before and after impact at full swing, approach or putting. As shown in FIG. 5, the interfering member 130 is arranged in parallel with a moving direction of a ball B at a desired height above the ball B by adjusting the first adjusting unit 111, the second adjusting unit 112 and the connecting unit 113 of the supporting member 110 supported on the ground by the leg member 120 to have the desired height, protruding length and angle.

Also, according to a user's level, the length of the interfering member 130 can be increased or decreased through the length adjusting unit 131 provided in the form of the wrinkled tubes on the interfering member 130, thereby causing the impact while tracing the maximum arc with respect to the ball B. By repeated practice of this pose, it is possible to prevent duffing or topping at the impact. Here, the duffing means that a user strokes the ground in back of the ball B, and the topping means that s/he strokes an upper part of the ball B.

Thus, if the head of the club C interferes with one side of the interfering member 130 while passing between the ground and the interfering member 130, as shown in FIG. 6, the second member 132*b* fastened to the middle of the interfering member 130 is separated from the first member 132*a* fastened to the second adjusting unit 112 by the impact transferred from the head of the club C. At this time, the elastic wire 133 connecting the first member 132*a* and the second member 132*b* prevents the interfering member 130 from moving far away, thereby facilitating reattachment.

Figure 7:
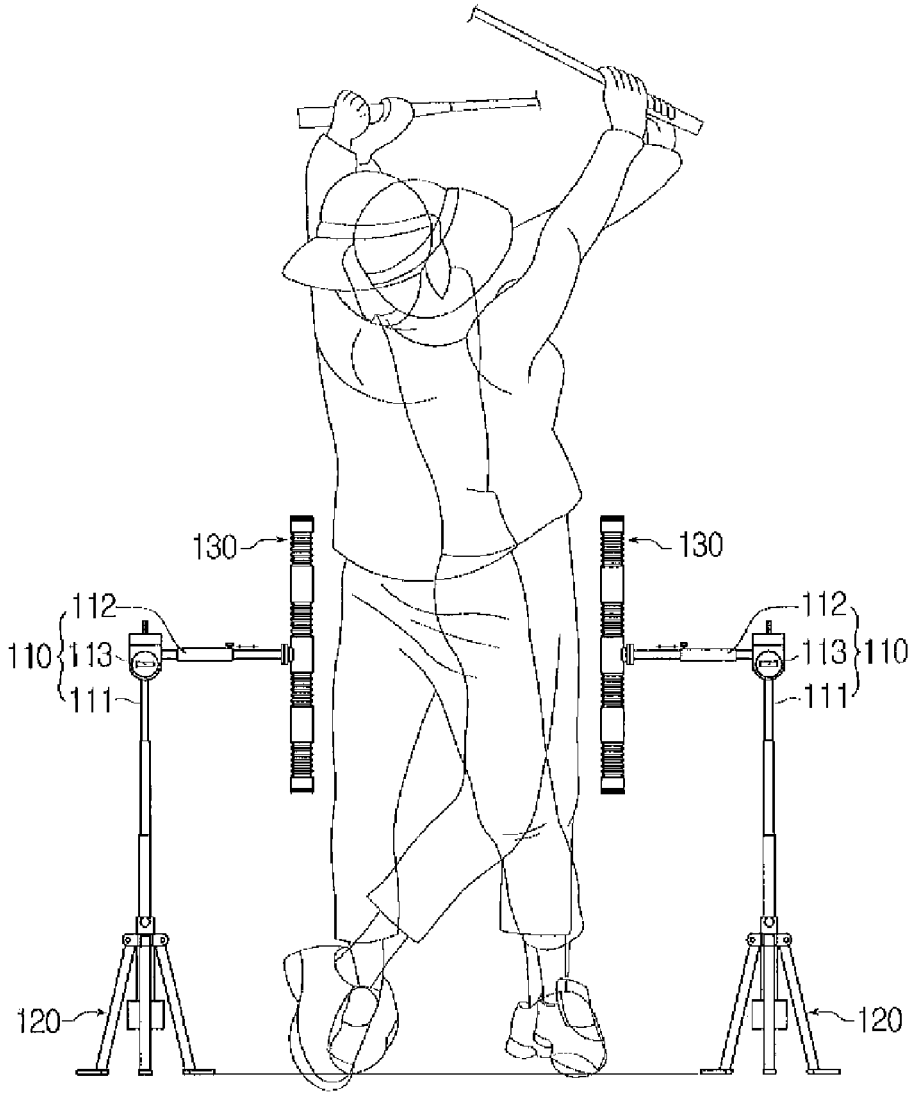

FIG. 7 is for preventing sway that a waist or leg 122 deviates from the right way like a back-swing hip or a finish hip at a swing action. As shown therein, the second adjusting unit 112 of the supporting member 110 supported by the leg member 120 is adjusted in inclination through the connecting unit 113 so that it can face toward the outside of a user's hip, and then the interfering member 130 attached to the end part of the second adjusting unit 112 via the detachable member 132 is adjusted to be disposed in a vertical direction around a user's hip.

Figure 8:
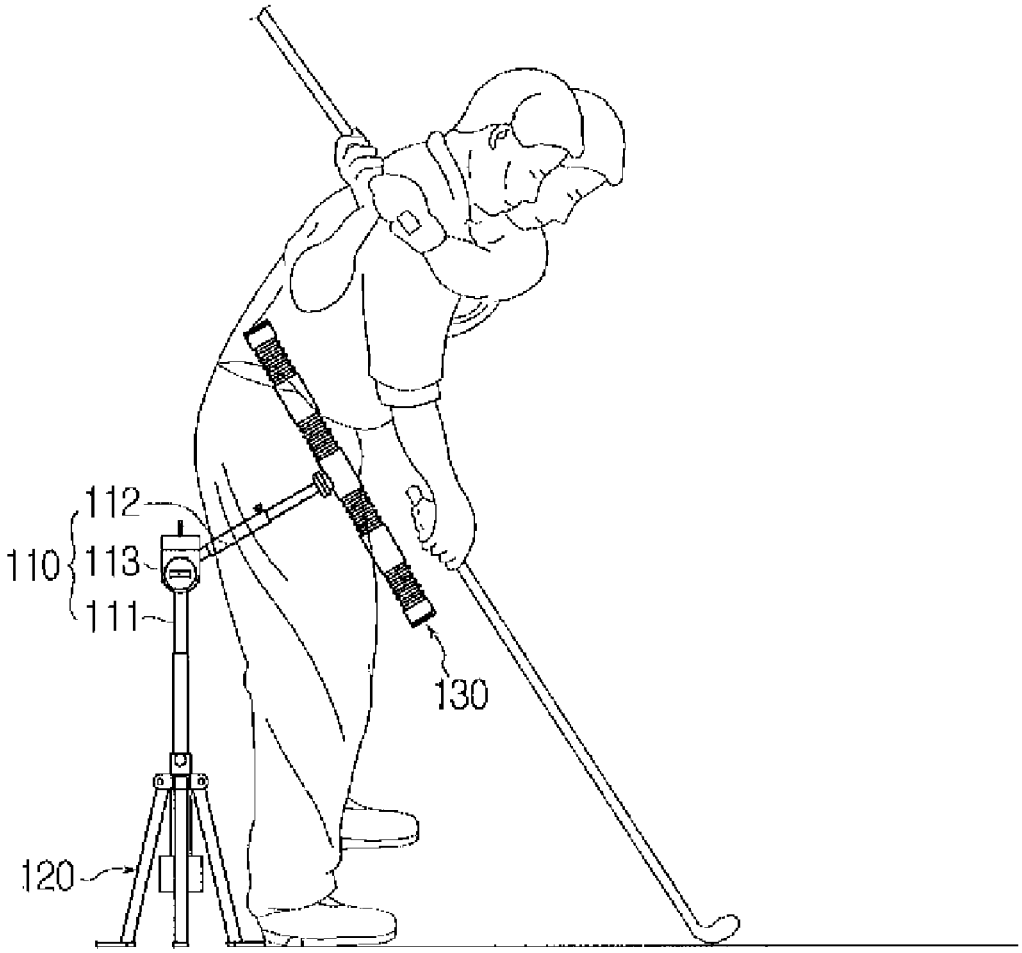

As described above, if the interfering members 130 are placed at opposite sides around the user's hip in the state that a user takes a stance for the swing, the sway of the hip or knee may interfere with the interfering member 130 during the swing, and thus the interfering member 130 may be separated from the supporting member 110. Through this, it is possible to correct the sway that may arise during the swing FIG. 8 is for maintaining a certain angle of a swing plane between a shaft of the club C and the ground when the shaft of the club C contacts the ball. As shown therein, in the state that the second adjusting unit 112 of the supporting member 110 supported on the ground by the leg member 120 is adjusted to be disposed in a direction perpendicular to the swing plane, the interfering member 130 installed at the end part of the second adjusting unit 112 is disposed in parallel with a target swing plane.

In the state that the angle of the interfering member 130 is adjusted as described above, the apparatus for correcting the golf pose is placed in a user's back-swing direction, so that a user can repeat the back swing and the down swing while paying attention to the interference member 130. Thus, it is possible to correct the swing plane at a desired angle.

Meanwhile, the length of the interfering member 130 may be increased or decreased through the length adjusting unit 131 according to a user's level. If the interfering member 130 becomes longer, the correction of the swing plane can be effectively improved.

Further, since the swing is maintained at a certain angle through this correction of the swing plane, it is possible to prevent a slice or hook that makes a golf ball deviate from a target direction.

Figure 9:
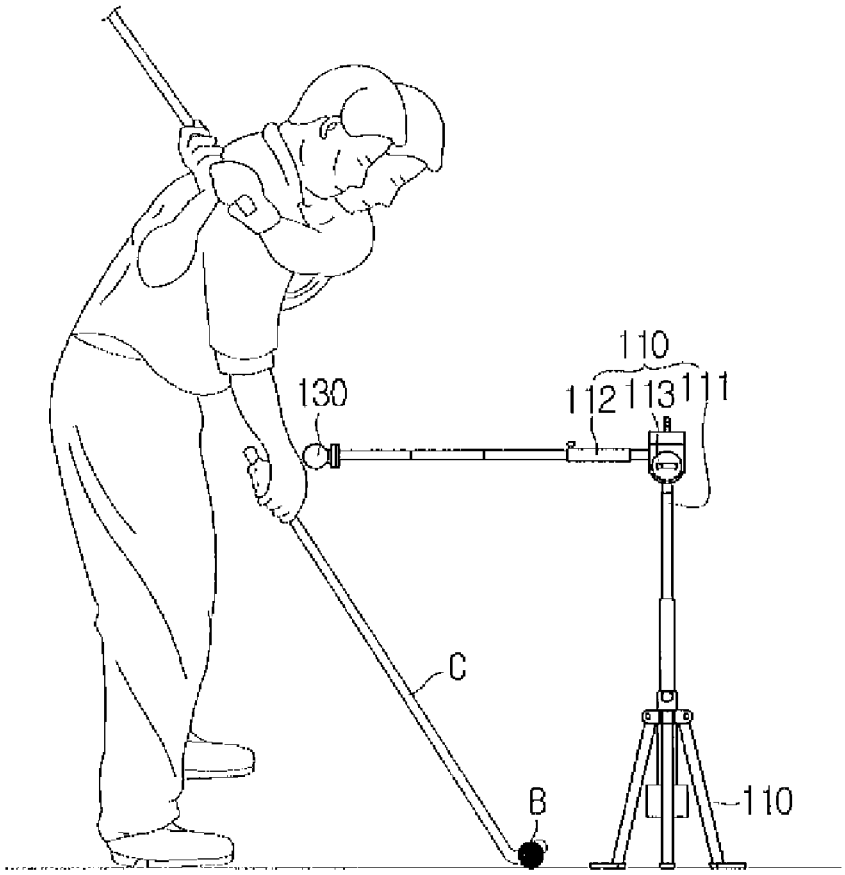

FIG. 9 is for practicing a back-swing angle with respect to a flying distance of a golf ball in a back-swing process of approach address. As shown therein, the second adjusting unit 112 of the supporting member 110 supported on the ground by the leg member 120 is disposed to be inclined upward from the first adjusting unit 111, and it is thus possible to limit the angle of the back swing through interference between the interfering member 130 installed at the end part of the first adjusting unit 111 and the shaft of the club C at a predetermined position during the back swing. By this, the flying distance of the golf ball is adjustable according to positions of setting a backward limit angle in the back-swing of the approach.

Figure 10:
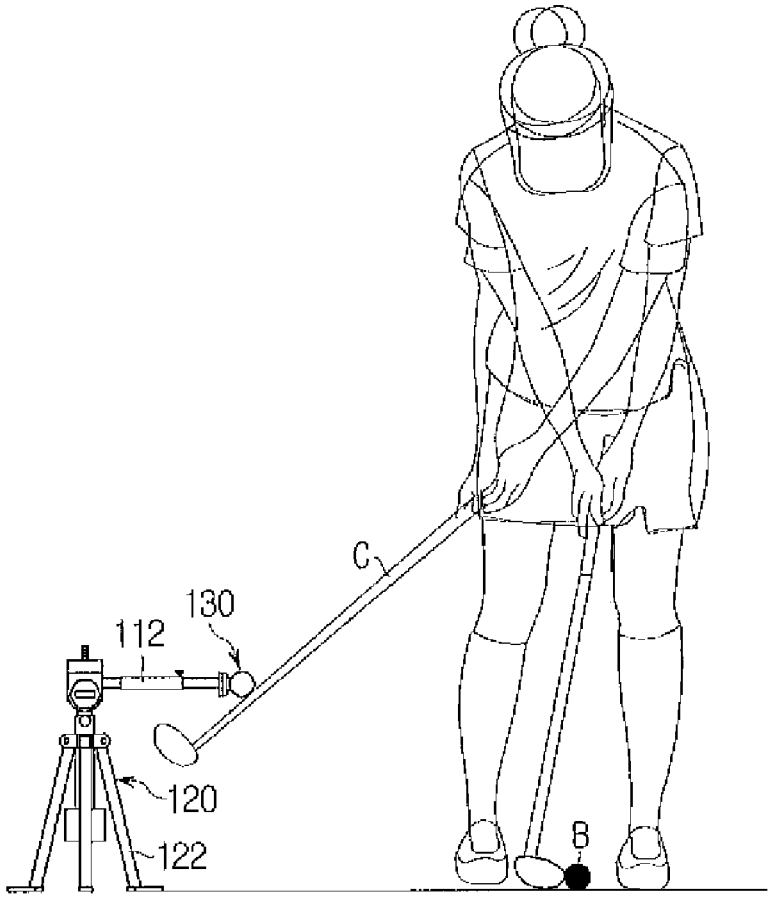
Figure 11:
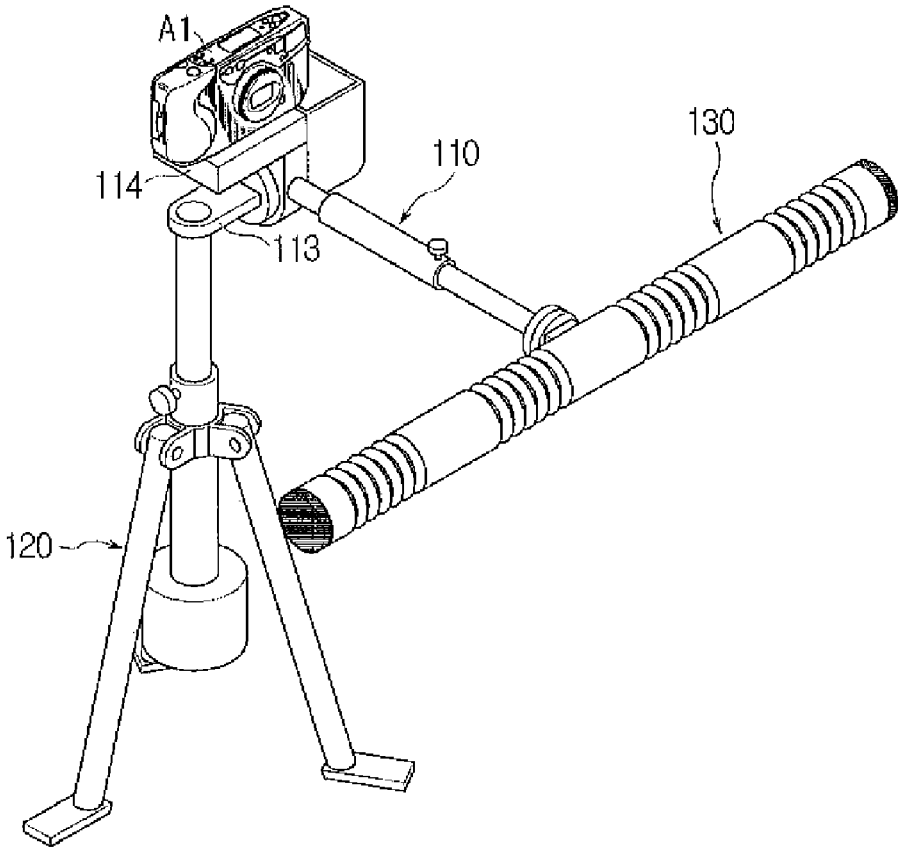
Figure 12:
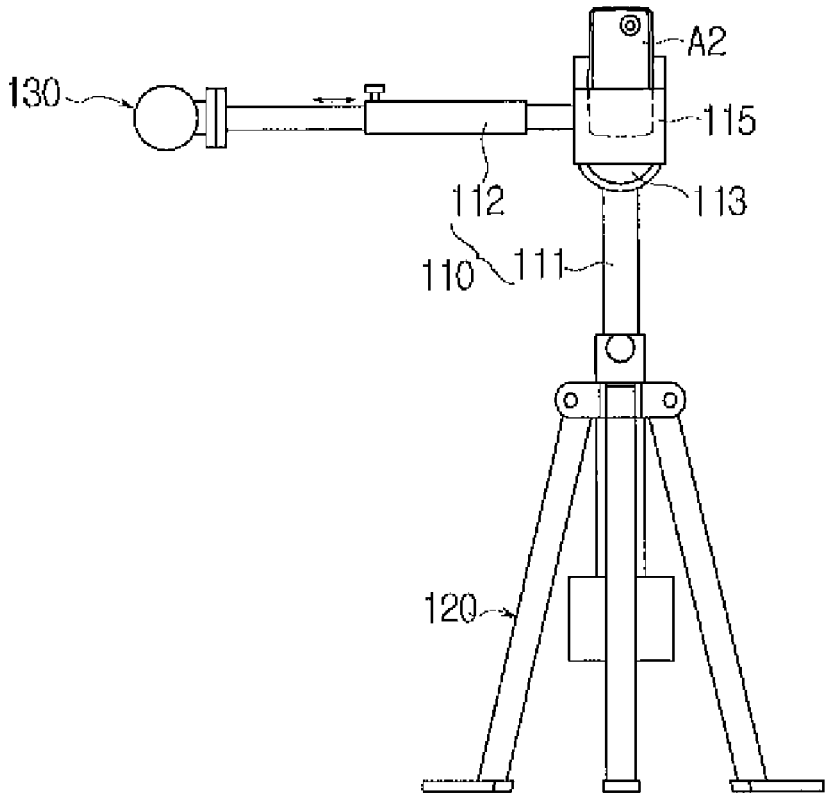

FIG. 10 is for correcting deviation of a grip position from the swing path in the swing process. As shown therein, the interfering member 130 is disposed in parallel with the moving direction of a golf ball above a grip at a position corresponding to impact in the swing path, and the first member 111 and the second member 112 of the supporting member 110 are lengthened enough to prevent the leg member 120 from interfering with the head of the club C.

Like this, if the interfering member 130 is positioned above the grip in the swing path, a grip part may interfere with the interfering member 130 when a position of the grip deviates from the swing path to one side or when the swing path does not maintain a smooth arc. Thus, it is possible to correct the pose while paying attention to whether the position of the grip deviates the swing path.

At this time, the length adjusting unit provided in the form of the wrinkled tubes may be used in adjusting the length of the interfering member 130 in order to correct the pose according to a user's level.

As described above, the apparatus for correcting the golf pose according to an exemplary embodiment separates the interfering member 130 from the supporting member when contacting the head of the club C or a part of a user's body as a swing pose is lost or the club C deviates from the swing path, thereby easily correcting the swing pose or the deviation of the club C from the swing path. Alternatively, the apparatus for correcting the golf pose according to an exemplary embodiment may be advantageously applied to various poses other than the foregoing poses by adjusting the length and angle of the supporting member 110.

In particular, the length and angle of the supporting member 110 may be adjusted to be used for various purposes, and the length of the interfering member 130 may be increased or decreased according to a user's level or use, thereby expanding usage for not only a beginner but also a superior.

Also, when the head of the club C or a part of a user's body contacts the interfering member 130, the interfering member 130 attached to the supporting member 1 with a magnetic force can be readily separated from the supporting member 1, thereby preventing the the supporting member 110 supported by the leg member 120 from falling or changing in its position.

Further, since the first member 132*a* and the second member 132*b* used as the contacting members that attach the interfering member 130 to the supporting member 110 are connected by the elastic wire 133, the interfering member 130 is prevented from moving far away even though it is separated from the supporting member 110, thereby facilitating reattachment. Also, the interfering member 130 is made of a soft synthetic resin and prevented from being damaged by impact due to contact with the head of the club C.

In the meantime, a camera A1 may be selectively installed on the camera plate 114 provided in the upper side of the connecting unit 113 so as to photograph a user's pose (refer to FIG. 11), and a mobile phone A2 that enters a video clip mode may be inserted in the insertion groove 115 formed at one side of the connecting unit 113 so that not only a video clip can be easily produced but also safekeeping of the mobile phone A2 can be facilitated.

As described above, there is provided an apparatus for correcting a golf pose, in which an interfering member is separated from a supporting member when contacting a part of a user's body or a club head as a swing pose is lost or a club deviates from a swing path, thereby easily correcting the swing pose or the swing path of the club.

Also, there is provided an apparatus for correcting a golf pose, which can be used in correction for various applicable poses by adjusting the length and angle of the supporting member, and expand its usage for not only a beginner but also a superior since the length of the interfering member is flexible corresponding to a user's ability or use.

Further, there is provided an apparatus for correcting a golf pose, which can prevent the supporting member supported by a leg member from easily falling or changing in its position because the interfering member attached to the supporting member by a magnetic force can be readily separated when contacting a part of a user's body or the club head.

Furthermore, there is provided an apparatus for correcting a golf pose, in which a first member and a second member used as contact members that attach the interfering member to the supporting member are connected by an elastic wire, so that the interfering member can be easily attached again since it is prevented from moving far away even though the interfering member is separated.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An apparatus for correcting a golf pose, the apparatus comprising:

a supporting member formed to be adjustable in length and angle; a leg member installed at one end part of the supporting member and supported on a ground; and an interfering member formed retractably in a lengthwise direction and detachably installed to the other end part of the supporting member through a detachable member; wherein the interfering member comprises at least one length adjusting unit to be adjusted in length; wherein the length adjusting unit comprises a wrinkled tube maintained in an adjusted length; wherein the interfering member is made of a soft synthetic resin, and is transparent in a middle part but opaque at opposite end parts; wherein the detachable member comprises a first member coupled to the other end part of the supporting member, and a second member fastened to the middle part of the interfering member and attached to/detached from the first member with a magnetic force; wherein the detachable member further comprises an elastic wire connecting the first member and the second member.

2. The apparatus according to claim 1, further comprising a weight fastened to a lower end part of the supporting member and improving stability when installed on the ground.

3. The apparatus according to claim 2, wherein the leg member comprises a bracket surrounding an outer circumference of the lower end part of the supporting member, a plurality of legs of which an upper end part is rotatably coupled to the bracket, and a foot formed in a lower end part of the leg and enlarging a contact area with the ground.

4. The apparatus according to claim 3, wherein the supporting member comprises a first adjusting unit having a retractable structure like an antenna and fastened to the leg member, a second adjusting unit having a retractable structure like an antenna and fastened to the interfering member, and a connecting unit connecting the first adjusting unit and the second adjusting unit such that the second adjusting unit can rotate in up, down, left and right directions.

5. The apparatus according to claim 4, wherein the connecting unit comprises a camera plate onto which a camera can be selectively installed.

6. The apparatus according to claim 5, wherein the connecting unit comprises an insertion groove at one side thereof, in which a mobile phone of a user can be inserted.

* * * * *